United States Patent [19]

Tanaka

[11] Patent Number: 4,569,470

[45] Date of Patent: Feb. 11, 1986

[54] BUTTON ORIENTING AND PLACING APPARATUS

[75] Inventor: Akira Tanaka, Kurobe, Japan

[73] Assignee: Nippon Notion Kogyo Co., Ltd., Tokyo, Japan

[21] Appl. No.: 662,356

[22] Filed: Oct. 18, 1984

[30] Foreign Application Priority Data

Oct. 18, 1983 [JP] Japan ..... 58-160918[U]

[51] Int. Cl.[4] ..... A41H 37/10

[52] U.S. Cl. ..... 227/119; 29/509; 227/116

[58] Field of Search ..... 29/718, 432.1, 809, 29/407; 227/117, 118, 119, 155, 116

[56] References Cited

U.S. PATENT DOCUMENTS

| | | | |
|---|---|---|---|
| 3,815,805 | 6/1974 | Beneteau | 227/119 |
| 4,007,537 | 2/1977 | Silverbush et al. | 227/119 X |
| 4,019,666 | 4/1977 | Foults | 227/119 |
| 4,427,146 | 1/1984 | Seki | 227/119 |

FOREIGN PATENT DOCUMENTS 52-60740 5/1977 Japan .

*Primary Examiner*—Paul A. Bell

*Attorney, Agent, or Firm*—Hill, Van Santen, Steadman & Simpson

[57] ABSTRACT

In a button orienting and placing apparatus, a pushing mechanism, for pushing a button out of a guide channel in a horizontal guide, includes a slide slidable in and along the guide channel, and a horizontal pushing plate pivotally mounted on the slide and having on its forward end a pushing surface engageable with a shank of the button so as to push the latter forwardly and against one of a pair of opposed side walls of the guide as the slide is moved forwardly along the guide channel. The pushing mechanism also includes a locking lever vertically pivotally mounted on the slide and having at its forward end a single downwardly directed claw projecting through an opening in the pushing plate for catching a tab of the button to thereby stop turning of the button.

3 Claims, 6 Drawing Figures

BUTTON ORIENTING AND PLACING APPARATUS

BACKGROUND OF THE INVENTION

1. Field of the Invention

The present invention relates to a machine for attaching fasteners such as buttons to a garment, and more particularly to an apparatus for orienting and placing buttons one at a time for attachment to a garment.

2. Prior Art

Machines for attaching buttons to a garment are known in which a button and its mating fastener part, such as a tack, are delivered one at a time from their respective chutes to a working station where a die and a punch coact to join the button and the mating fastener part together in clinched condition with the garment placed therebetween. If the button bears on its front side a design, mark or symbol requiring a specified angular position in which the button is to be mounted on a garment, it is necessary to orient the button in such required direction.

Japanese Patent Laid-Open Publication (Kokai) No. 52-60740, corresponding to U.S. Pat. No. 4,019,666, discloses a button orienting apparatus including a pusher slide slidably received in a guide channel of a guide for pushing a button through the guide channel, and a friction plate having a frictional surface exposed to the guide channel for frictional engagement with a peripheral edge portion of the button head to cause the button to roll on the frictional surface as the button is pushed by the pusher slide in the guide channel. This rolling of the button continues until a tab on the back side of the button is caught by a pair of spaced claws on a locking lever mounted on the pusher slide; the button having thus been oriented in a required direction then slides on the frictional surface of the friction plate. However, this prior apparatus is disadvantageous in that the peripheral edge portion of the button head is subject to abrasions, grazes or other damage as the button head slides on the frictional surface of the friction plate, because the friction plate is normally urged inwardly by springs which are so strong as to cause one of the spaced claws to ride over the tab.

SUMMARY OF THE INVENTION

In the present button-orienting-and-placing apparatus, a pushing mechanism, for pushing a button out of a guide channel in a horizontal guide, includes a slide slidable in and along the guide channel, and a horizontal pushing plate mounted on the slide and having on its forward end a pushing surface engageable with a shank of the button so as to push the latter forwardly and against one of a pair of opposed side walls of the guide as the slide is moved forwardly along the guide channel. The pushing mechanisum also includes a locking lever vertically pivotally mounted on the slide and having at its forward end a single downwardly directed claw projecting through an opening in the pushing plate for catching a tab of the button to thereby stop turning of the button.

It is therefore an object of the present invention to provide a button orienting and placing apparatus which enables smooth and accurate orientation of a button under a small amount of frictional resistance between a pheripheral edge portion of the button head and one side wall of the guide channel, thus keeping the button free from any abrasion, graze or other damage.

Many other advantages, features and additional objects of the present invention will become manifest to those versed in the art upon making reference to the detailed description and the accompanying drawings in which a preferred embodiment incorporating the principles of the present invention is shown by way of illustrative example.

DETAILED DESCRIPTION

Figure 1:
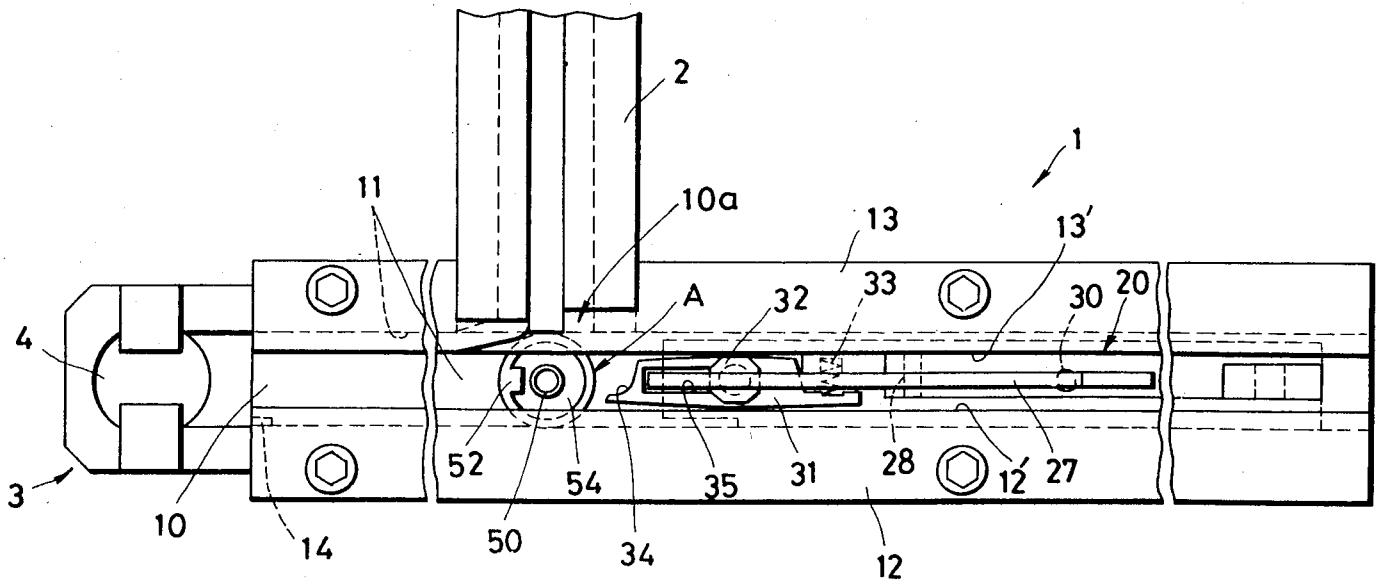
FIG. 1 is a fragmentary plan view of a button orienting and placing apparatus embodying the present invention.
Figure 2:
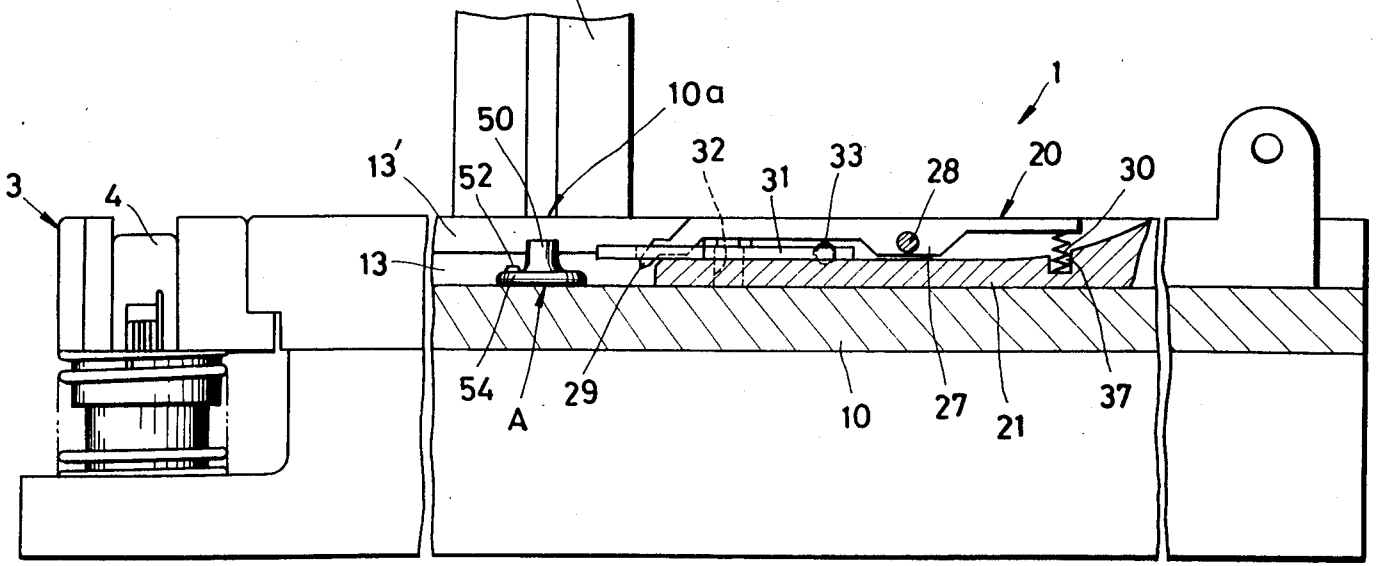
FIG. 2 is a fragmentary side elevational view, partly in cross section, of the apparatus of FIG. 1.

As shown in FIGS. 1 and 2, a button orienting and placing apparatus 1 generally comprises an elongate horizontal guide 10 mounted on a support 5 for guiding buttons A one at a time from a chute 2 to a working station 3 in which a die 4 is disposed contiguous to one end of the guide 10, and a pusher mechanism 20 slidably supported on the guide 10 for pushing the button A out of the guide 10 onto the die 4.

The guide 10 has a pair of opposed first and second side walls 12, 13 defining therebetween a longitudinal guide channel 11 for the passage of the button A, each side wall 12, 13 having an inwardly directed flange 12', 13'. The guide 10 has an inlet **10*a* to which a lower end of the chute 2 is connected for introducing the button A into the guide channel 11. The guide channel 11 has an open end adjacent to the die 4**.

Figure 3:
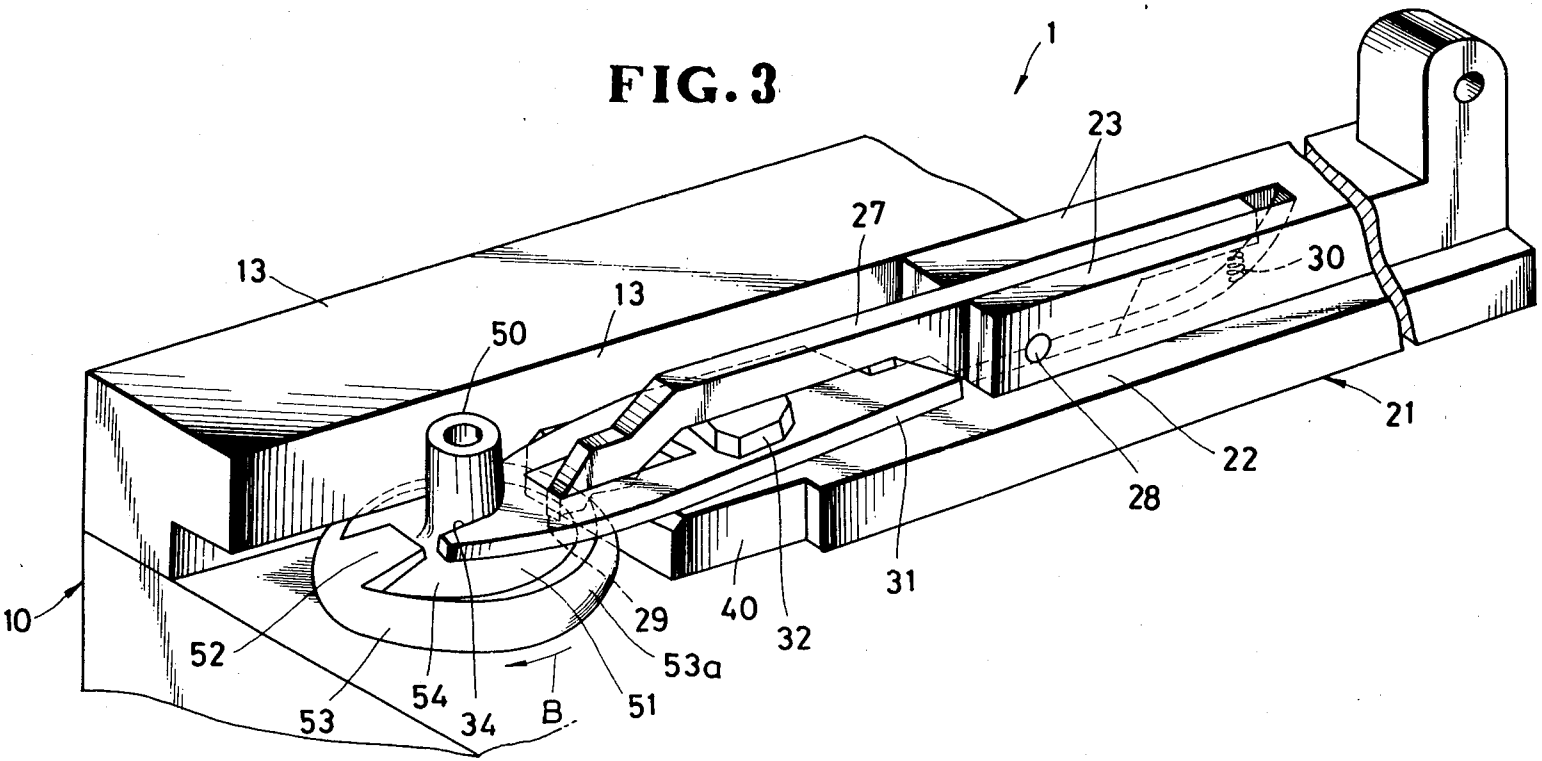
FIG. 3 is an enlarged fragmentary perspective view of a pusher mechanism, showing the manner in which a button is oriented.
Figure 4:
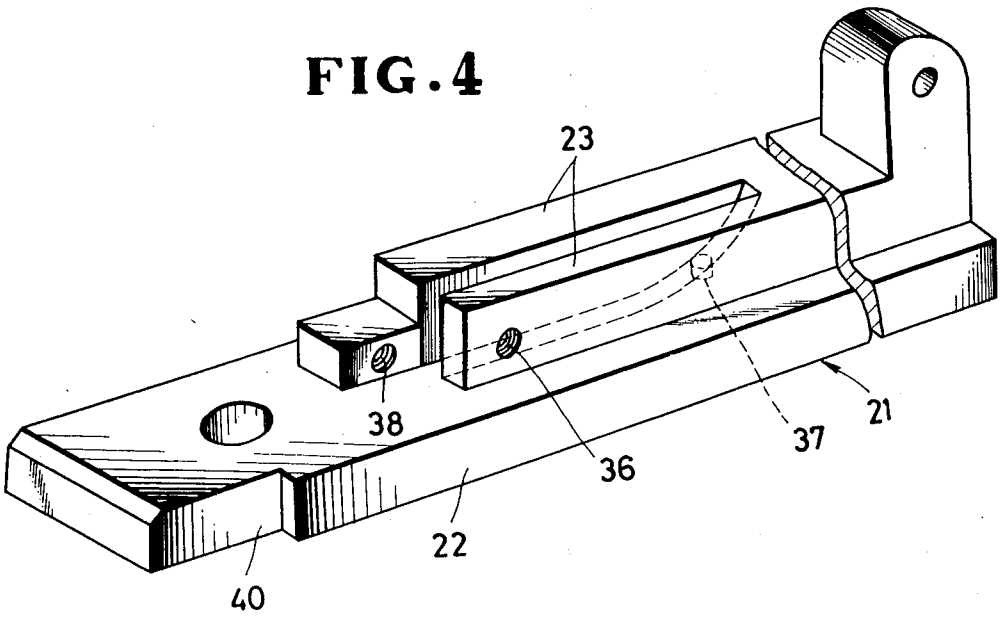
FIG. 4 is a fragmentary perspective view of a slide of the pusher mechanism of FIG. 3.

As best shown in FIG. 3, the individual button A includes a disk-shaped head 54 and a shank 50 projecting centrally from the back side of the head 54. The head 54 is covered over the front side thereof by a decorative cap 53 bearing a design, mark, emblem or symbol (not shown) requiring a specified direction in which the button A is to be oriented when attached to a garment (not shown). The decorative cap 53 has a rim portion **53*a* extending around a peripheral edge of the head 54 so as to provide a substantially ring-shaped shallow recess 51 around the shank 50, there being a tab 52 projecting radially from the rim portion 53*a* in the recess 51. The tab 52 is disposed at a predetermined position which corresponds to the specified direction of the non-illustrated design on the decorative cap 53**.

The pusher mechanism 20, as shown in FIGS. 1–6, includes an elongate slide 21 slidably received in the guide channel 11 for movement therealong, and a horizontal pushing plate 31 horizontally pivotally mounted on the slide 21 by a headed screw 32 and having on its forward end portion a pushing surface 34 engageable with the shank 50 of the button A so as to push the latter forwardly and against the second side wall 13 of the guide 10 as the slide 21 is moved forwardly along the guide channel 11. This forward movement of the slide 21 is restricted by a projection 14 (FIG. 1 and 5) engageable with a recess 40 (FIGS. 1, 3, 4 and 5) in a forward end portion of the slide 21. The pushing surface 34 is inwardly curved or concave in such a manner that the forward end portion has a width becoming smaller progressively toward its distal end, as viewed in plan view. This contour of the pushing surface 34 causes the peripheral edge portion of the button head 54 and thus the rim portion 53*u* of the cap 53 to engage against the second side wall 13 so that the button head 54 rolls on the second wall 13 as the shank 50 of the button A is pushed forwardly by the pushing plate 31. The pushing plate 31 is normally urged by a relatively weak compression spring 33 to turn clockwise in FIGS. 1, 3 and 5, the spring 33 being received in a blind hole 38.

The pusher mechanism 20 also includes a locking lever 27 vertically pivotally mounted on the slide 21 by a pin 28 having opposite ends received in a pair of holes 36, 36 in a pair of parallel projections 23, 23, respectively. The locking lever has at its forward end a single downwardly directed claw 29 (FIGS. 2, 3 and 6) projecting through an opening 35 in the pushing plate 31 into the ring-shaped recess 51 (FIG. 3) of the button A for catching the tab 52 of the button A to thereby stop turning or rolling of the button A. A compression spring 30 is disposed between the slide 21 and the locking lever 27 to urge the latter to turn counterclockwise in FIG. 2; the clawed end portion of the locking lever 27 is thus urged downwardly. Such downward movement of the clawed end portion is restricted by a head of the screw 32. The slide 21 is operatively connected to a suitable drive means (not shown) for reciprocating movement in the guide channel 11 between a first or retracted position (FIGS. 1 and 2) in which both the pushing plate 31 and the locking lever 27 are retracted behind the inlet 10*a* for allowing the button A to be introduced into the guide channel 11 via the inlet 10*a*, and a second or projected position (FIGS. 5 and 6) in which both the pushing plate 31 and the locking lever 27 project from the open end of the guide channel 11 for pushing the button A out of the guide channel 11 onto the die 15.

In FIGS. 1 and 2, when the slide 21 is moved leftwardly, i.e. forwardly in the guide channel 11 toward the die 4, the forward end portion of the pushing plate 31 pushes the shank 50 of the button A. Partly because of the concave pushing surface 34 on the forward end portion of the pushing plate 31 and partly because of the relatively weak spring 33, the rim portion 53*a* of the cap 53 on the button head 54 is resiliently urged against the second side wall 13 so that the button head 54 rolls thereon smoothly. The button A thus turns in the direction indicated by an arrow B in FIG. 3 until the tab 52 of the button A is caught by the claw 29 of the locking lever 27 to thereby stop turning of the button A. After having been caught by the claw 29, the button A slides rather than rolls on the second side wall 13 smoothly. Thus the button A has been oriented in the specified direction that corresponds to the position of the tab 52.

Figure 5:
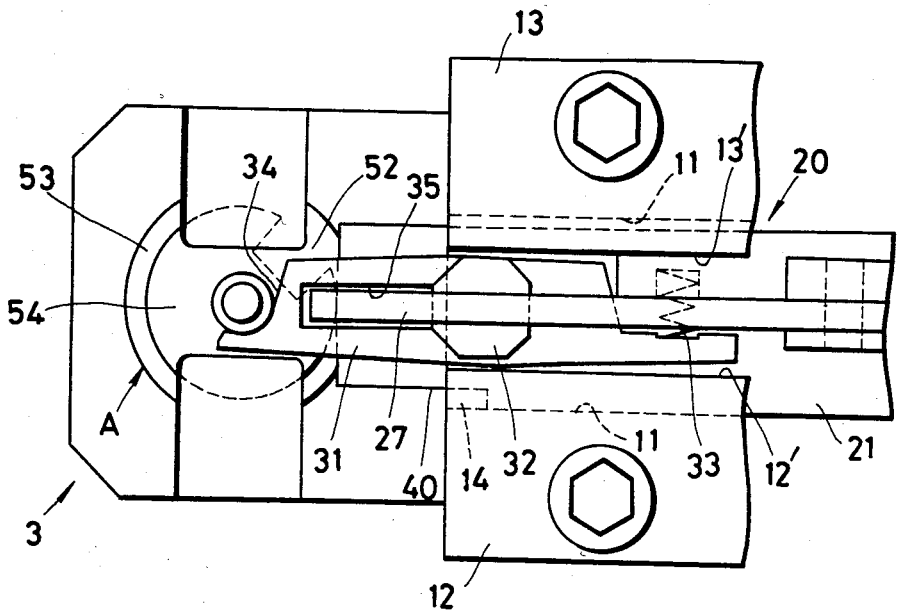
FIG. 5 is an enlarged fragmentary plan view of the apparatus, showing the pushing mechanism having been moved to a forward position to thereby place the button on a die.
Figure 6:
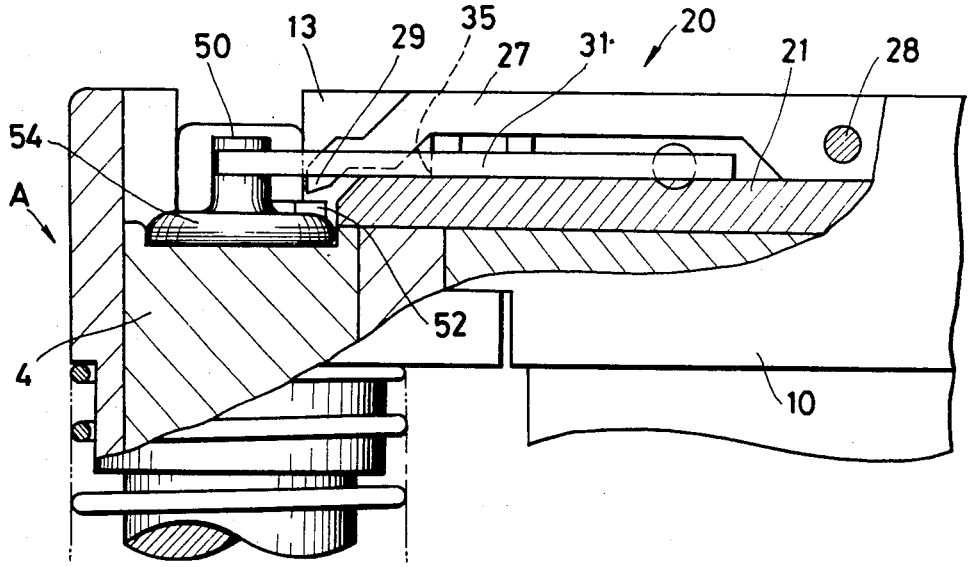
FIG. 6 is a side elevational view, with parts broken away, of FIG. 5.

With continued forward movement of the slide 21, the oriented button A with the tab 52 caught by the claw 29 of the locking lever 27 is pushed out of the guide channel 11 onto the die 4, as shown in FIGS. 5 and 6. As a result, the button A has been placed on the die 4, which coacts with a punch (not shown) to join the button A and a tack (not shown) together in clinched condition with a garment (not shown) placed therebetween, as is well known in the art. The slide 21 along with the pushing plate 31 and the locking lever 27 is retracted from the die 4 before the non-illustrated punch is lowered toward the die 4.

In the arrangement thus constructed, the turning of the button A is stopped when the tab 52 is merely blocked by the only claw 29 of the locking lever 27 projecting into the ring-shaped recess 51 of the button A. That is, only a small amount of frictional resistance between the rim portion 53*a* of the cap 53 (the peripheral edge portion of the button head 54) and the second side wall 13 will suffice to cause the button head 54 to roll on the side wall 13. Consequently it is possible to place the button A on the die 4 accurately in a specified orientation smoothly without any abrasion, graze or other damage on the peripheral edge of the button head 54.

Although various minor modifications may be suggested by those versed in the art, it should be understood that I wish to embody within the scope of the patent warranted hereon, all such embodiments as reasonably and properly come within the scope of my contribution to the art.

What is claimed is:

1. An apparatus for orienting and placing a button for attachment onto a gafment at a working station in a button attaching machine, the button including a disk-shaped head, a shank projecting centrally from a back side of the head, and a tab disposed on the back side of the head and extending radially thereof, said apparatus comprising:

(a) a horizontal guide having a pair of opposed side walls defining therebetween a guide channel for the passage of the button, said guide having an inlet through which the button is introduced into said guide channel, said guide channel having an open end for being disposed contiguous to the working station; and (b) a pusher mechanism for pushing the button out of said guide channel to the working station, said pusher mechanism including (1) a slide slidably mounted on said guide for movement in and along said guide channel, (2) a horizontal pushing plate mounted on said slide and having on its forward end portion a pushing surface engageable with the shank of the button so as to push the latter forwardly and against one of said opposed side walls of said guide as said slide is moved forwardly along said guide channel, said pushing plate having an opening in said forward end portion, (3) a locking lever vertically pivotally mounted on said slide and having at its forward end a single downwardly directed claw projecting through said opening in said pushing plate for catching the tab of the button to thereby stop turning of the button, and (4) a first spring normally urging said locking lever to pivot so as to cause said claw to move downwardly.

2. An apparatus according to claim 1, said pushing plate being horizontally pivotable within said guide channel and being normally urged by a second spring to pivot so as to cause said forward end portion to move toward said one side wall of said guide.

3. An apparatus according to claim 1, said pushing surface being concave in such a manner that said forward end portion has a width becoming smaller progressively toward its distal end.

* * * * *